US009890004B2

(12) United States Patent
Dahlqvist

(10) Patent No.: US 9,890,004 B2
(45) Date of Patent: Feb. 13, 2018

(54) DEVICE AND METHOD FOR FEEDING PAPERS

(71) Applicant: PLOCKMATIC INTERNATIONAL AB, Hägersten (SE)

(72) Inventor: Patrik Dahlqvist, Täby (SE)

(73) Assignee: PLOCKMATIC INTERNATIONAL AB, Hagersten (SE)

( * ) Notice: Subject to any disclaimer, the term of this patent is extended or adjusted under 35 U.S.C. 154(b) by 0 days.

(21) Appl. No.: 15/273,766

(22) Filed: Sep. 23, 2016

(65) Prior Publication Data

US 2017/0008716 A1 Jan. 12, 2017

Related U.S. Application Data

(63) Continuation of application No. PCT/SE2015/050341, filed on Mar. 23, 2015.

(51) Int. Cl.
*B65H 7/16* (2006.01)
*B65H 3/48* (2006.01)
(Continued)

(52) U.S. Cl.
CPC ..... *B65H 7/16* (2013.01); *B65H 1/14* (2013.01); *B65H 3/06* (2013.01); *B65H 3/08* (2013.01);
(Continued)

(58) Field of Classification Search
CPC ..... B65H 7/16; B65H 1/18; B65H 2511/152; B65H 3/48; B65H 2406/12; B65H 2406/121; B65H 2406/1211; B65H 2406/122; B65H 2406/1222; B65H 2406/13; B65H 2515/212
See application file for complete search history.

(56) References Cited

U.S. PATENT DOCUMENTS 7,500,665 B2 * 3/2009 Lamendola ..... B65H 3/48 271/97
7,568,691 B2 * 8/2009 Matsumoto ..... B65H 3/48 271/97
(Continued)

FOREIGN PATENT DOCUMENTS

JP 2005104723 A 4/2005

*Primary Examiner* — Jeremy R Severson
(74) *Attorney, Agent, or Firm* — Moser Taboada

(57) ABSTRACT

A method for feeding sheets of paper comprises the following steps: providing a stack of papers on a storage surface of a paper feeding device; providing a flow of air for separating an uppermost sheet of paper from the rest of the stack of papers; determining the vertical position of the uppermost sheet of paper; adjusting the flow of air in dependence on the determined vertical position of the uppermost sheet of paper; and repeating the steps of determining the vertical position of the uppermost sheet of paper and adjusting the flow of air in dependence on the determined vertical position of the uppermost sheet of paper. During continuous operation, the flow of air is controlled in cycles with one part of the cycle, preferably the first part of the cycle, with a higher flow of air, and one part of the cycle, preferably the second part of the cycle, with a lower flow of air. By imparting the uppermost sheet of paper a pulsating movement up and down, the problems associated with electrostatic charging are mitigated.

17 Claims, 5 Drawing Sheets

(51) Int. Cl.

| | |
|---|---|
| ***B65H 1/14*** | (2006.01) |
| ***B65H 3/06*** | (2006.01) |
| ***B65H 7/02*** | (2006.01) |
| ***B65H 3/08*** | (2006.01) |
| ***B65H 5/06*** | (2006.01) |

(52) U.S. Cl.

CPC ..... *B65H 3/48* (2013.01); *B65H 5/06* (2013.01); *B65H 7/02* (2013.01); *B65H 2406/13* (2013.01); *B65H 2511/152* (2013.01); *B65H 2511/22* (2013.01); *B65H 2515/212* (2013.01); *B65H 2553/30* (2013.01)

(56) References Cited

U.S. PATENT DOCUMENTS

| | | | | |
|---|---|---|---|---|
| 7,591,459 | B2 * | 9/2009 | Matsumoto | B65H 1/14 271/97 |
| 8,141,865 | B2 * | 3/2012 | Utagawa | B65H 3/128 271/31 |
| 8,444,138 | B2 * | 5/2013 | Taki | B65H 3/128 271/105 |
| 9,061,848 | B2 * | 6/2015 | Okamoto | B65H 3/08 |
| 9,199,810 | B2 * | 12/2015 | Shimoyama | B65H 3/128 |
| 2011/0101600 | A1 * | 5/2011 | Chihara | B65H 1/14 271/152 |
| 2011/0163492 | A1 | 7/2011 | Taki | |
| 2011/0170883 | A1 * | 7/2011 | Suzuki | G03G 15/6538 399/18 |

* cited by examiner

DEVICE AND METHOD FOR FEEDING PAPERS

This application is the continuation of International Application No. PCT/SE2015/050341, filed 23 Mar. 2015, which claims the benefit of Swedish Patent Application No. SE 1450340-3, filed 24 Mar. 2014, the entire contents of which are hereby incorporated by reference.

TECHNICAL FIELD

The present invention relates generally to a device and a method for feeding sheets of paper in a feeder or sorter, preferably in a vertical friction feeder, and more particularly to a device and a method wherein the sheet of papers are pre-separated by controlled blowing of air.

BACKGROUND ART

There are essentially two types of feeders for use for after-treatment of sheets of paper in printing machines and copiers, viz. friction feeder and vacuum feeders. In friction feeder, individual sheets are picked from piles of sheets by the fact that a rotary feeding roll is abutted against and pulls the top sheet from the pile, wherein a subjacent friction block normally retains subjacent sheets of the pile. Friction feeders are robust and in general reliable in operation, but occasionally more than one sheet at a time may happen to be picked mistakenly. The feeding rolls may also leave marks in the sheets. In vacuum feeders, sheets are picked from piles by the fact that the top sheet of the pile is sucked against a conveyor belt for transportation of the sheet to subsequent further processing. The vacuum feeder has not the disadvantages mentioned above of the friction feeder, but the function thereof is more sensitive and a vacuum feeder is considerably more expensive than a friction feeder.

Another disadvantage of friction feeders is that when picking sheets, the top sheet is drawn against the closest subjacent sheet of the pile, the picked sheet being electrostatically charged, which often gives rise to problems in after-treatment steps. The sheets namely get a tendency to stick to each other as a consequence of the electrostatic charge, which hampers, e.g., putting together and adjustment of sheets into a sheaf having straight edges in a stapling and folding machine when stapling together the sheaf for the formation of a booklet. Since colour printing and colour copying have become more and more common, the described problem of electrostatic charging of the sheets has become even greater, since coloured paper has a greater tendency to be charged than paper with black-and-white print.

In large copiers and printing machines, it is previously known to separate sheets of paper in the paper magazines of the machines by blowing air from the side through the magazine. In doing so, air is supplied through central supply ducts to exhaust nozzles at the magazine or the magazines from a central fan unit situated at a distance from the magazine or the magazines.

SUMMARY OF INVENTION

An object of the present invention is to overcome the problems in prior art with electrostatic charging in friction feeding devices and to provide a friction feeding device with improved reliability.

According to a first aspect of the invention there is thus provided a method for feeding sheets of paper, comprising the following steps: providing a stack of papers on a storage surface of a paper feeding device; providing a flow of air for separating an uppermost sheet of paper from the rest of the stack of papers; determining the vertical position of the uppermost sheet of paper; adjusting the flow of air in dependence on the determined vertical position of the uppermost sheet of paper; and repeating the steps of determining the vertical position of the uppermost sheet of paper and adjusting the flow of air in dependence on the determined vertical position of the uppermost sheet of paper, wherein, during continuous operation, the flow of air is controlled in cycles with one part of the cycle, preferably the first part of the cycle, with a higher flow of air, and one part of the cycle, preferably the second part of the cycle, with a lower flow of air. By imparting the uppermost sheet of paper a pulsating movement up and down, the problems associated with electrostatic charging are mitigated.

In a preferred embodiment, the first and second parts of the cycle are of equal length.

In a preferred embodiment of the method, the higher flow of air is essentially two times the lower flow of air.

In a preferred embodiment of the method, the vertical position of the uppermost sheet of paper is determined after each cycle with a higher flow of air and if the determined vertical position of the uppermost sheet of paper deviates from a desired position, for the next cycle the higher flow of air will be adjusted upward if the determined vertical position was lower than the desired position and downward the determined vertical position was higher than the desired position. It is then preferred, for the next cycle, that the higher flow of air is adjusted upward or downward if the determined vertical position of the uppermost sheet of paper deviates from a desired position by more than a predetermined threshold value.

Preferably, the duration of each cycle is 2-10 seconds, more preferably 4-7 seconds, most preferably essentially 5 seconds. This allows for pulsation of the uppermost sheet of paper.

In a preferred embodiment of the method, during start-up operation, the uppermost sheet of paper is lifted from an initial position and the flow of air is increased, preferably incrementally, until a desired vertical position of the uppermost sheet of paper is reached.

In a preferred embodiment of the method, the desired position of the uppermost sheet of paper is 5-15, and preferably essentially 10 millimeters, above an initial position before operation.

According to a second aspect of the invention, a paper feeding device is provided comprising: a storage surface for a stack of papers and being adapted to be move vertically between a first, lower end position and a second, upper end position, a feeding roll for feeding papers from their position on the storage surface and imparting an uppermost sheet of paper a horizontal displacement, a fan arrangement adapted to provide a curtain of air separating the uppermost sheet of paper from the rest of the stack of papers, wherein the paper feeding device is characterized by a sensor provided above the stack of papers and adapted and arranged to measure an actual vertical position of the uppermost sheet of paper and a control unit connected to the fan arrangement and to the feeding roll for controlling the operation thereof in dependence of a measured actual vertical position of the uppermost sheet of paper.

In a preferred embodiment, the fan arrangement comprises pairs of fans adapted to provide a flow of air separating the uppermost sheet of paper from the rest of the stack.

In a preferred embodiment, the fan arrangement is adapted to blow a substantially vertical air curtain through the stack of papers so as to separate the uppermost sheet of paper from the rest of the sheets of the stack of papers.

In a preferred embodiment, the sensor is an ultrasound sensor, which preferably is approximately centrally above the storage surface.

In a preferred embodiment, the control unit is connected to the fan arrangement, to the feeding roll and to a mechanical elevator for the storage surface for controlling the operation thereof in accordance with the method according to the method according to the invention.

A paper processing machine is also provided which comprises a paper feeding device according to any one of claims.

BRIEF DESCRIPTION OF DRAWINGS

The invention is now described, by way of example, with reference to the accompanying drawings, in which.

DESCRIPTION OF EMBODIMENTS

In the following, a detailed description of a paper feeding device according to the invention will be given. Special references given in the description, such as "up" or "down", refer to directions during normal operation of the device.

Figure 1:
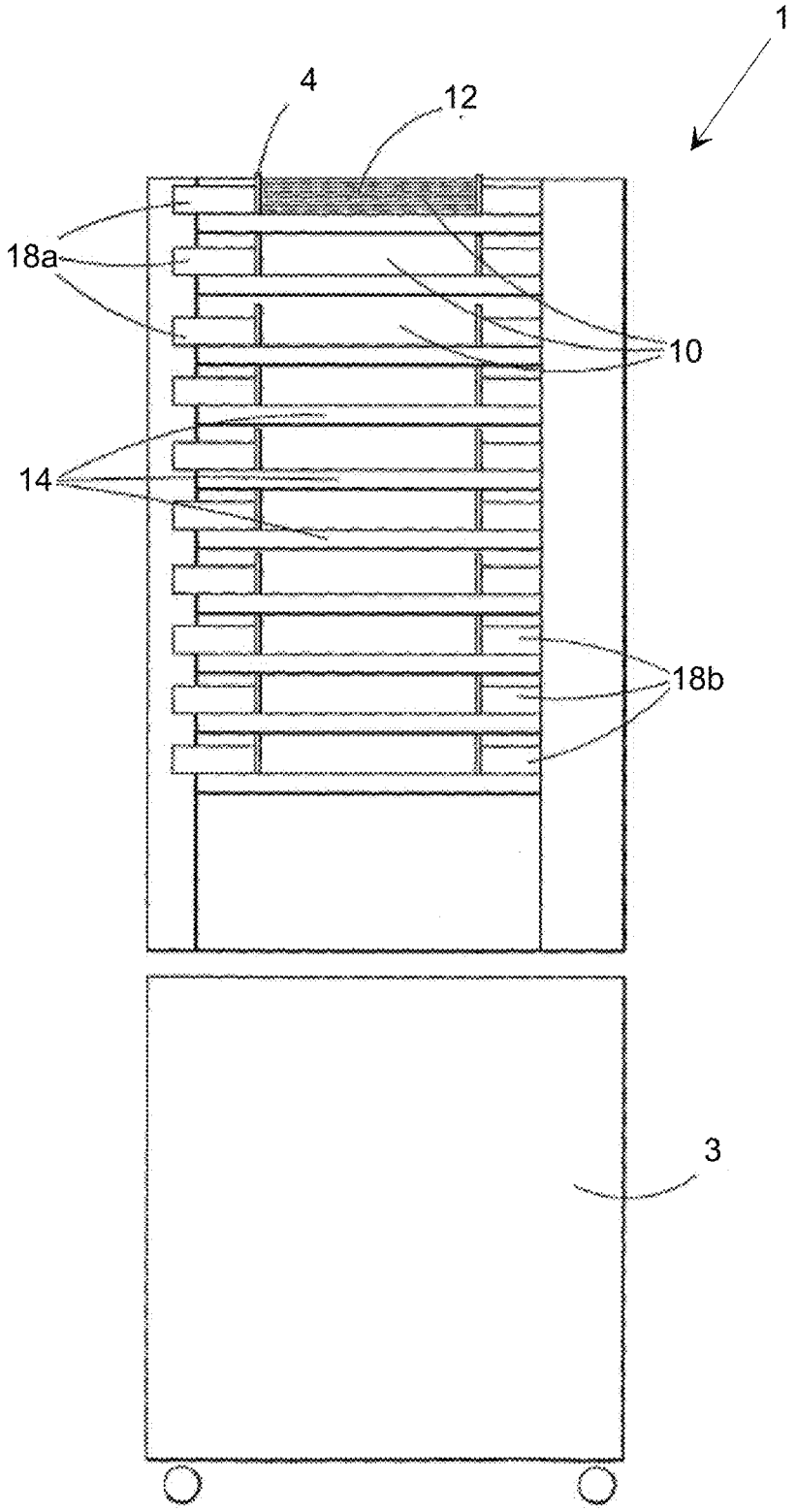
FIGS. 1 and 2 show an embodiment of a vertical friction sorter from the front and in a side view, respectively, which is provided with a paper feeding device according to the invention.
Figure 2:
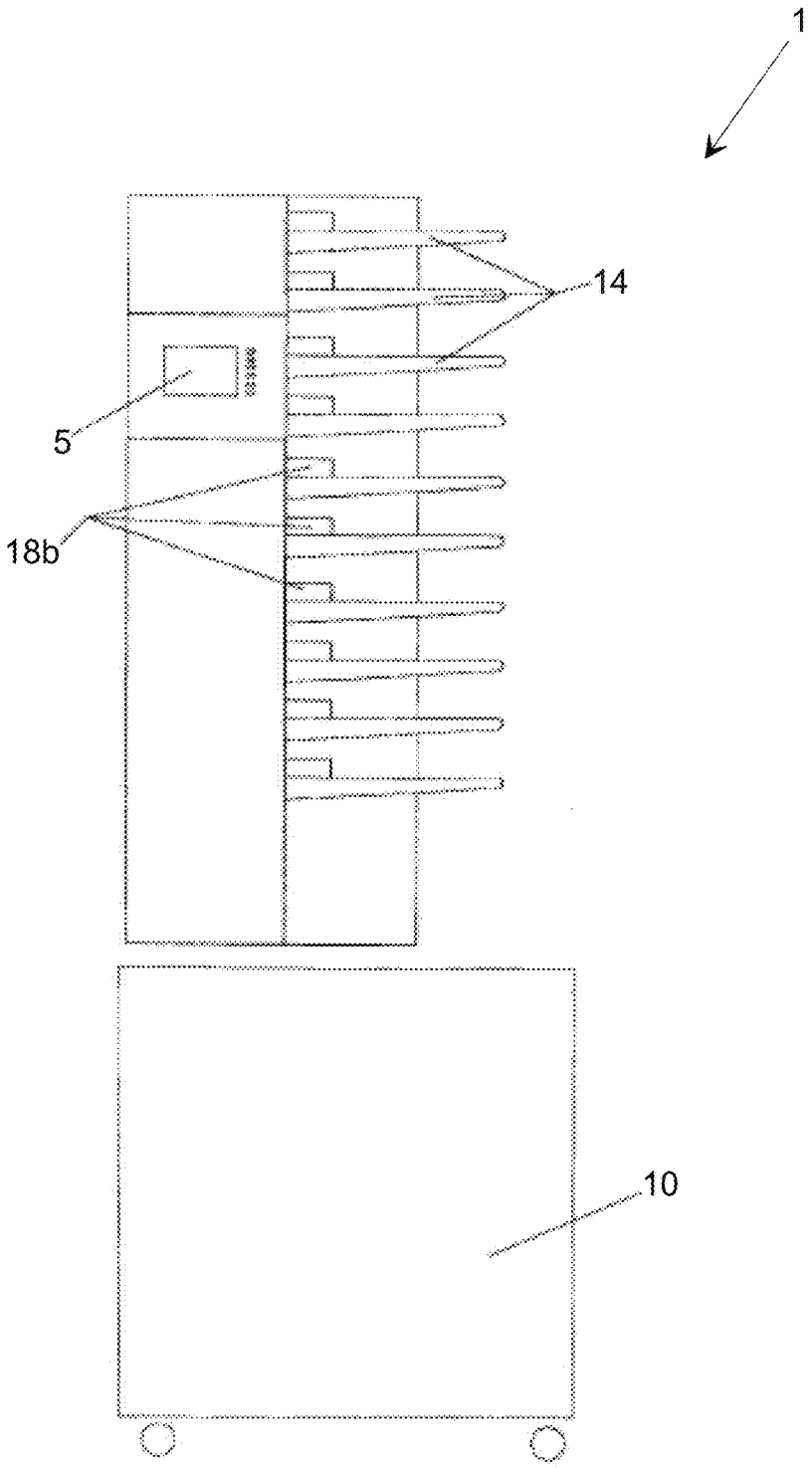
Figure 5:
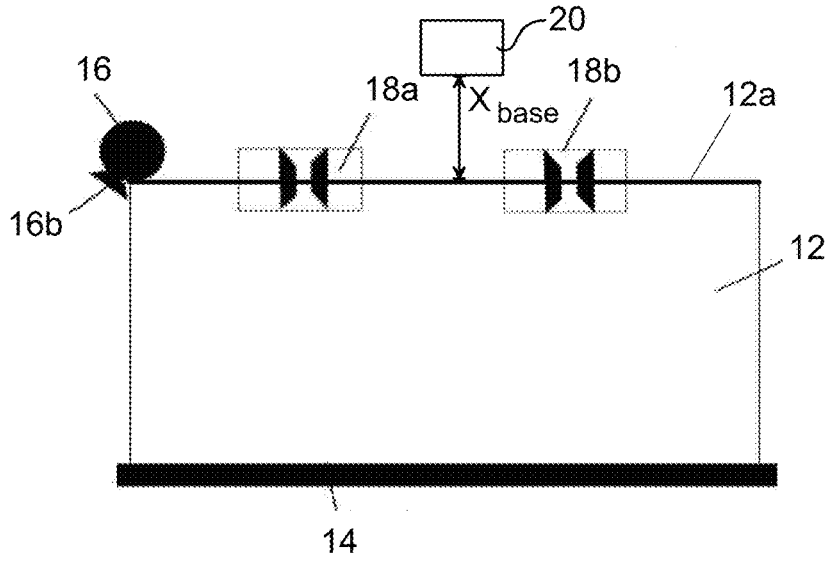
FIG. 5 is a side view of the paper feeding device of FIG. 4 before operation.
Figure 6:
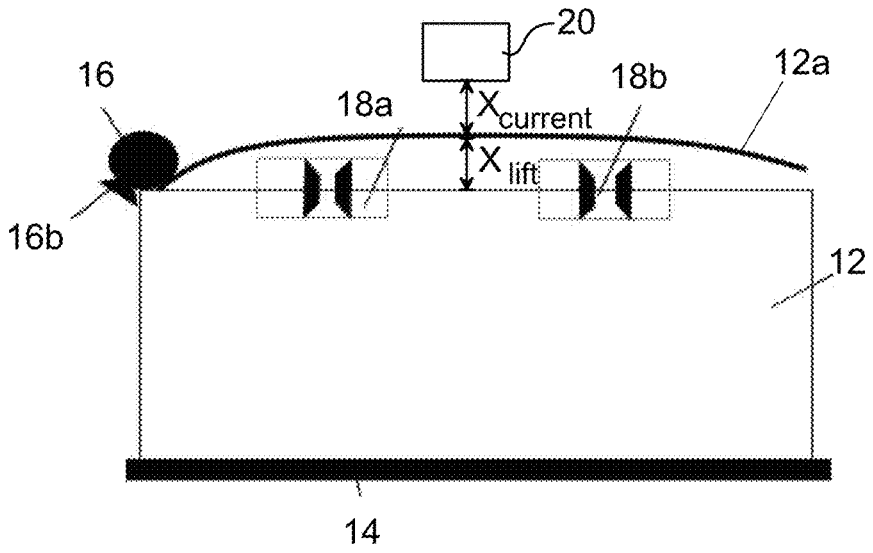
FIG. 6 is a side view of the paper feeding device of FIG. 4 in a first half of an operation cycle.

Reference is first made to FIGS. 1 and 2 showing a vertical friction sorter in which a paper feeding device according to the invention is provided. The vertical friction sorter, generally designated 1, comprises a plurality of stations 10 arranged above each other and resting on a control cubicle 3 containing other equipment of the vertical friction sorter. Each station 10 is intended to house a pile of sheets 12 of paper lying on each other, shown in the top station in FIG. 1. Each station 10 comprises a paper magazine having a storage surface 14 on which the pile of sheets rests. From the paper magazines, sheets are fed out or are picked, one at a time, using feeding rolls 16, as will be described below with reference to FIGS. 3-6 that are brought into frictional engagement with the top sheet of the pile 12, such as shown in FIGS. 4-6.

In FIG. 2, an operating device for the control of the machine is also shown, in the form of an LCD screen 5 for displaying miscellaneous information about the operation of the machine as well as a number of control buttons.

Figure 3:
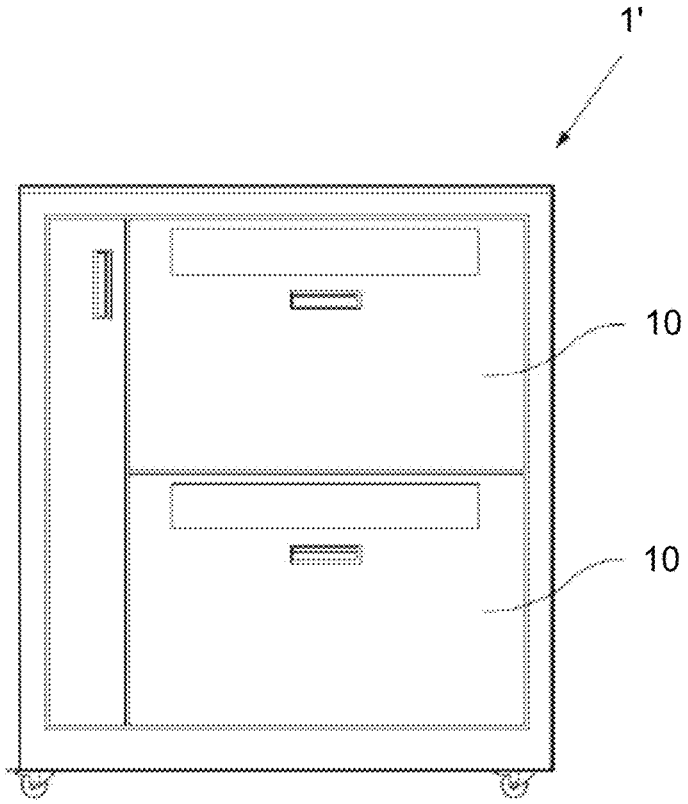
FIG. 3 is a side view of a feeder provided with two paper feeding devices according to the invention.

In FIG. 3 a machine in the form of a feeder 1' is shown, which is provided with two paper feeding devices 10 according to the invention.

Figure 4:
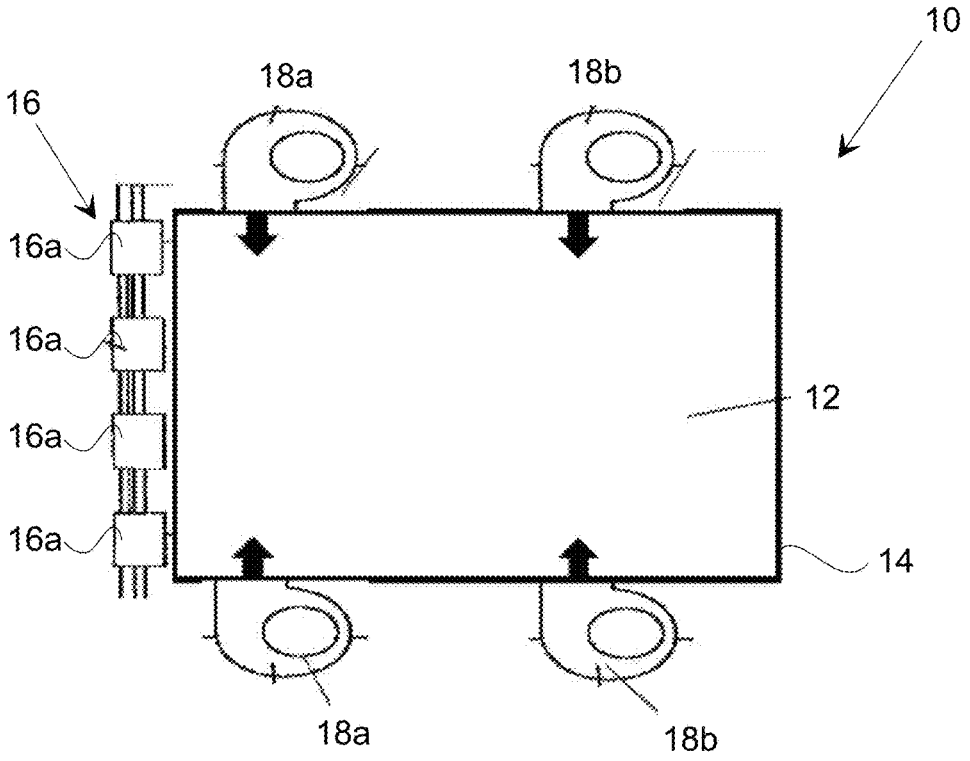
FIG. 4 is a plan view of a paper feeding device according to the invention.

A plan view of a paper feeding device 10 according to the invention is shown in FIG. 4. A stack of papers 12 is provided on a storage surface 14 in the form of a mechanical elevator adapted to be move vertically between a first, lower end position and a second, upper end position. In this context, the term "stack of papers" should be interpreted as at least two papers, but usually the stack of papers comprises a much higher number of sheets. A feeding roll 16 extends across essentially the entire with of the stack of papers 12 and comprises in the shown embodiment four sub-rolls 16*a-d*. The feeding roll is provided for the feeding of papers from their position on the storage surface 14 and imparts the uppermost sheet of paper 12*a* a horizontal displacement to the left, as shown in the figures.

The feeding roll 16 is also provided with a separations block 16*b* adapted to provide friction to ensure that only a single sheet of paper is fed by the feeding roll.

The paper feeding device 10 also comprises a fan arrangement in the form of pairs of fans 18*a*, 18*b* adapted to provide a flow of air separating the uppermost sheet of paper 12*a* from the rest of the stack. Each fan is preferably provided with a nozzle having a slot-shaped exhaust opening substantially vertical or orientated substantially perpendicularly to the storage surface, see FIGS. 4-6, for blowing a substantially vertical air curtain through the stack of sheets so as to separate the sheets of the stack of papers 12.

Figure 8:
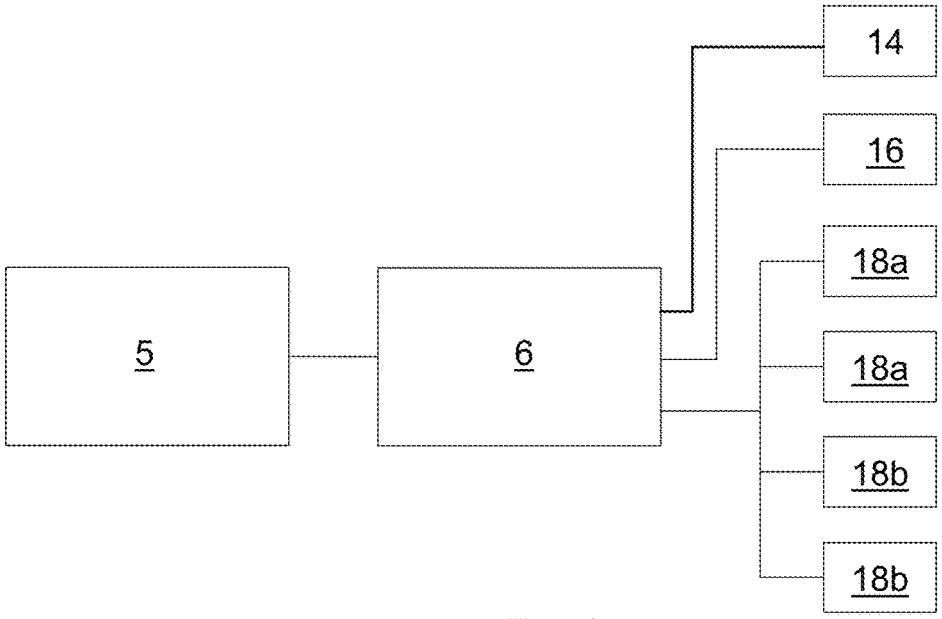
FIG. 8 is an overall block diagram showing the different components of a paper processing machine comprising a paper feeding device according to the invention.

The air flow from the fans 18*a*, 18*b* is adjustable by means of a control unit 6, which is schematically shown in FIG. 8. The control unit is connected to the fans and to the feeding roll as well as to the mechanical elevator of the storage surface for controlling the operation thereof as well as to the operating device 5 for the input and output of control parameters etc. There are at least two controllable air flow velocities, although there is preferably more than two controllable air flow velocities or step-less adjustment of the air flow velocities. By means of the controllable air flow velocities the position of the uppermost sheet of paper 12*a* is controlled, as will be explained below.

Figure 7:
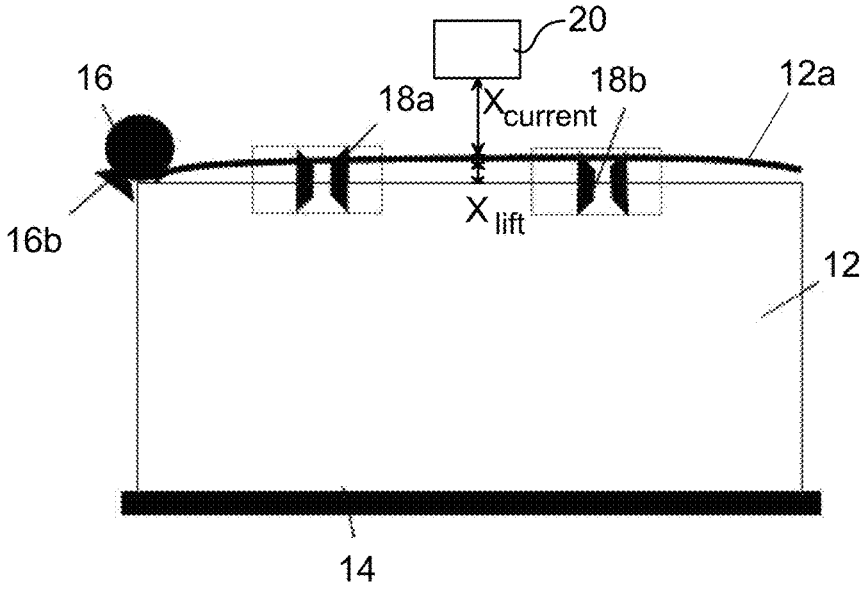
FIG. 7 is a side view of the paper feeding device of FIG. 4 in a second half of an operation cycle.

A sensor 20 is provided a distance above the stack of papers 12. The sensor 20, which preferably is an ultrasound sensor, is adapted and arranged to measure the actual vertical position of the uppermost sheet of paper 12*a*. In this context, the term "the vertical position of the uppermost sheet of paper" should be interpreted as the position of the portion of the sheet of paper directly below the sensor. Thus, other portions of the uppermost sheet of paper may have other vertical positions, as shown in FIGS. 6 and 7. It is therefore preferred to provide the sensor 20 approximately centrally above the storage surface 14 and thereby the stack of papers 12.

A method of feeding papers will now be described in detail with reference to FIGS. 5-7, wherein a stack of papers 12 has been provided on the storage surface 14. When the operation of the paper feeding device is started, a mechanical elevator of the storage surface 14 brings the stack of papers 12 up to an operating position shown in FIG. 5. In this position, the uppermost sheet of paper 12*a* is in contact with the feeding roll 16. The mechanical elevator of the storage surface 14 is then controlled so that this position is constant during operation, i.e. that the uppermost sheet of paper 12*a* is in contact with the feeding roll 16, irrespectively of the thickness of the stack of papers.

After reaching the operating position shown in FIG. 5, a start-up procedure is initiated wherein the fans 18*a*, 18*b* are started and are controlled to operate in a start-up mode with low power for a time period, such as a few seconds, for example 2 seconds. This low power may initially be adjusted to 10% of full power. The vertical position of the uppermost sheet of paper 12*a*, i.e., the actual position, is then measured by means of the sensor 20. In the position shown in FIG. 5, i.e., when the uppermost sheet of paper is in contact with the feeding roll but before operation of the fans, this distance between the sensor 20 and uppermost sheet of paper 12*a* is designated "$X_{base}$" In FIGS. 6 and 7, after operation has begun, the distance between the sensor 20 and the uppermost sheet of paper 12*a* is designated "$X_{current}$".

In an alternative embodiment, the value $X_{base}$ may be assumed to be constant between operations and therefore be a fixed value.

By means of the knowledge of $X_{base}$ and the current value of $X_{current}$, the amount of lifting of the uppermost sheet of paper 12*a*, designated $X_{lift}$ in the figures, can be determined as follows:

$$X_{lift}=X_{base}-X_{current}$$

The control algorithm includes a predetermined desired vertical adjustment of the uppermost sheet of paper 12*a*, i.e., a desired value of $X_{current}$, called $X_{desired}$. This value $X_{desired}$ may be based on experience and may be 10 millimeters, for example. This value may also vary depending on the quality of the paper, the kind of printing, the size of the sheets of paper etc.

The position error, i.e., difference between the actual adjustment $X_{current}$ and the desired adjustment $X_{desired}$ of the vertical position of the uppermost sheet of paper 12*a* is then determined by means of the control unit 6. The position error is compared to a threshold value $X_{threshold}$, such as 0.1 millimeters, and if the absolute value of the position error is above this threshold value, the fans are operated with an adjusted power for a predetermined period of time. In other words, during start-up operation, wherein the uppermost sheet of paper 12*a* is lifted from the position shown in FIG. 5, if $X_{lift}<X_{desired}$, the power of the fans 18*a*, 18*b* is increased, preferably incrementally, until $X_{lift}\geq X_{desired}$. In a preferred embodiment, the increment is 10% of full power. This means that the fan power starts at 10% of full power, then increases to 20%, 30% etc. until the sensor 20 senses that the uppermost sheet of paper has been lifted the desired distance $X_{desired}$.

When the control unit determines that the start-up operation has been completed, the feeding roll 16 is activated to transport the uppermost sheet of paper 12*a* from the stack of papers 12. The thickness of the stack of papers 12 thereby decreases, whereby the mechanical elevator of the storage surface 14 adjusts the vertical position of the storage surface upward until the uppermost sheet of paper abuts the feeding roll 16. Also, electrostatic charge begins to build up as soon as feeding has been initiated.

After feeding has been initiated, the operation of the fans 18*a*, 18*b* changes to a continuous operation mode. In this mode, the fan control is in cycles with the first part of the cycle with a higher power $P_{high}$ and the second part of the cycle with a lower power $P_{low}$. In a preferred embodiment, the first and second parts of the cycle are of equal length, i.e., they correspond to a first half and a second half of a cycle. However, the relative length of the two parts may vary, such as the first part corresponds to 70% of the cycle and the second part corresponds to 30% of the cycle, or any other suitable combination. In a preferred embodiment, $P_{high}$ is two times $P_{low}$. The initial value of $P_{high}$ may preferably be two times the final fan power in the start-up procedure.

By means of this continuous mode of operation, the upper sheets of paper are forced to pulsate up and down. By starting the cycle with a higher power, the upper sheets of paper are further separated, as shown in FIG. 6.

After the first half of each cycle, such as 2.5 seconds, the sensor senses the distance to the uppermost sheet of paper 12*a*. If the calculated value of $X_{lift}$ deviates from $X_{desired}$ with more than the predetermined threshold value, for the next cycle the higher power $P_{high}$ will be adjusted upward or downward, for example by 10% of the full power, depending on whether $X_{lift}$ was higher or lower than $X_{desired}$.

A second half of the cycle then follows, with a duration of 2.5 seconds, for example, wherein the fan power is $P_{low}$. The uppermost sheet of paper then sinks to a lower position shown in FIG. 7.

A new cycle is then started, with a first half with a possibly adjusted $P_{high}$. The sensor again senses the distance to the uppermost sheet of paper and $P_{high}$ for the next cycle is possible adjusted. The first cycle is followed by a second cycle with a possibly adjusted $P_{low}$. This continuous operation mode continues until operation is interrupted.

Preferred embodiments of a method for feeding sheets of papers and a paper feeding device have been described. It will be appreciated that these can be modified without departing from the inventive idea as defined by the appended claims. Thus, although reference has been made to "the uppermost sheet of paper", it will be appreciated that two, three or even more sheets of paper may be lifted by means of the air flow from the fans. This does not affect the functionality of the inventive method and device.

The paper feeding device has been described as part of a vertical feeder or sorter comprising a plurality of paper feeding devices. It will be appreciated that the inventive paper feeding device may be provided in any kind of machine adapted to process sheets of paper, such as paper collators and cover feeders.

A specific fan arrangement has been shown and described. It will be appreciated that any kind of fan arrangement will be possible as long as the fan power can be regulated and the stream of air lifts the uppermost sheet of paper in the stack of paper.

The invention claimed is:

1. A method for feeding sheets of paper, comprising the following steps:

providing a stack of papers on a storage surface of a paper feeding device;

providing a flow of air for separating an uppermost sheet of paper from the rest of the stack of papers;

determining a vertical position of the uppermost sheet of paper;

adjusting the flow of air in dependence on the determined vertical position of the uppermost sheet of paper; and repeating the steps of determining the vertical position of the uppermost sheet of paper and adjusting the flow of air in dependence on the determined vertical position of the uppermost sheet of paper, wherein, during continuous operation, the flow of air is controlled in cycles with one part of the cycle with a higher flow of air (Phigh), and one part of the cycle with a lower flow of air (Plow), and wherein the first and second parts of the cycle are of equal length.

2. The method according to claim 1, wherein the higher flow of air ($P_{high}$) is essentially two times the lower flow of air ($P_{low}$).

3. The method according to claim 1, wherein the vertical position of the uppermost sheet of paper is determined after each cycle with a higher flow of air ($P_{high}$) and if the determined vertical position ($X_{lift}$) of the uppermost sheet of paper deviates from a desired position ($X_{desired}$), for the next cycle the higher flow of air ($P_{high}$) will be adjusted upward if the determined vertical position ($X_{lift}$) was lower than the desired position ($X_{desired}$), and downward if the determined vertical position ($X_{lift}$) was higher than the desired position ($X_{desired}$).

4. The method according to claim 3, wherein, for the next cycle, the higher flow of air ($P_{high}$) will be adjusted upward or downward if the determined vertical position ($X_{lift}$) of the uppermost sheet of paper deviates from a desired position ($X_{desired}$) by more than a predetermined threshold value ($X_{threshold}$).

5. The method according to claim 4, wherein the desired position ($X_{desired}$) is 5-15 millimeters, above an initial position ($X_{base}$) before operation.

6. The method according to claim 3, wherein the desired position ($X_{desired}$) is 5-15 millimeters, above an initial position ($X_{base}$) before operation.

7. The method according to claim 1, wherein the duration of each cycle is 2-10 seconds.

8. The method according to claim 1, wherein, during start-up operation, the uppermost sheet of paper is lifted from an initial position ($X_{base}$) and the flow of air is increased until a desired vertical position ($X_{desired}$) of the uppermost sheet of paper is reached.

9. The method according to claim 8, wherein the desired position ($X_{desired}$) is 5-15 millimeters, above an initial position ($X_{base}$) before operation.

10. The method according to claim 8, wherein the flow of air is increased incrementally.

11. A paper feeding device comprising:

a storage surface for a stack of papers adapted to be moved vertically between a first, lower end position and a second, upper end position, a feeding roll for feeding papers from their position on the storage surface and imparting an uppermost sheet of paper a horizontal displacement, a fan arrangement adapted to provide a curtain of air separating the uppermost sheet of paper from the rest of the stack of papers, wherein a sensor provided above the stack of papers adapted and arranged to measure an actual vertical position of the uppermost sheet of paper, and a control unit connected to the fan arrangement and the feeding roll for controlling the operation thereof in dependence of a measured actual vertical position of the uppermost sheet of paper, wherein, during continuous operation, the flow of air is controlled in cycles with one half of the cycle with a higher flow of air ($P_{high}$), and one half of the cycle with a lower flow of air ($P_{low}$), wherein the first and second parts of the cycle are of equal length.

12. The paper feeding device according to claim 11, wherein the fan arrangement comprises pairs of fans adapted to provide a flow of air separating the uppermost sheet of paper from the rest of the stack.

13. The paper feeding device according to claim 11, wherein the fan arrangement is adapted to blow a substantially vertical air curtain through the stack of papers so as to separate the uppermost sheet of paper from the rest of the sheets of the stack of papers.

14. The paper feeding device according to claim 11, wherein the sensor is an ultrasound sensor.

15. The paper feeding device according to claim 11, wherein the sensor is provided approximately centrally above the storage surface.

16. The paper feeding device according to claim 11, wherein the control unit is connected to the fan arrangement, to the feeding roll and to a mechanical elevator for the storage surface for controlling the operation thereof in accordance with the method comprising the steps of:

providing a stack of papers on a storage surface of a paper feeding device;

providing a flow of air for separating an uppermost sheet of paper from the rest of the stack of papers;

determining the vertical position of the uppermost sheet of paper;

adjusting the flow of air in dependence on the determined vertical position of the uppermost sheet of paper; and repeating the steps of determining the vertical position of the uppermost sheet of paper and adjusting the flow of air in dependence on the determined vertical position of the uppermost sheet of paper, wherein, during continuous operation, the flow of air is controlled in cycles with one part of the cycle with a higher flow of air (Phigh), and one part of the cycle with a lower flow of air (Plow).

17. A paper processing machine comprising a paper feeding device according to claim 11.

* * * * *